US006517090B1

(12) United States Patent
Fullum

(10) Patent No.: US 6,517,090 B1
(45) Date of Patent: Feb. 11, 2003

(54) ERGONOMIC SKATE BOOT WITH SHOCK ABSORBER

(75) Inventor: Jean-François Fullum, Montreal (CA)

(73) Assignee: Bauer Nike Hockey Inc., Montreal (CA)

( * ) Notice: Subject to any disclaimer, the term of this patent is extended or adjusted under 35 U.S.C. 154(b) by 0 days.

(21) Appl. No.: 09/446,747

(22) PCT Filed: May 1, 1998

(86) PCT No.: PCT/CA98/00443

§ 371 (c)(1),
(2), (4) Date: Dec. 28, 1999

(87) PCT Pub. No.: WO99/56840

PCT Pub. Date: Nov. 11, 1999

(51) Int. Cl.[7] ..... A63C 17/04
(52) U.S. Cl. ..... 280/11.221
(58) Field of Search ..... 280/11.19, 11.221, 280/11.224, 11.225, 11.231, 11.27, 11.28, 842

(56) References Cited

U.S. PATENT DOCUMENTS

| | | | | | |
|---|---|---|---|---|---|
| 4,915,399 | A | * | 4/1990 | Marandel | 280/11.28 |
| 5,029,882 | A | * | 7/1991 | Marandel | 280/11.209 |
| 5,405,156 | A | * | 4/1995 | Gonella | 280/11.28 |
| 5,582,418 | A | * | 12/1996 | Closser | 280/11.225 |
| 5,639,104 | A | * | 6/1997 | Haldemann | 280/11.231 X |
| 5,823,543 | A | * | 10/1998 | Burns et al. | 280/11.225 |
| 5,961,131 | A | * | 10/1999 | Hilgarth | 280/11.225 X |
| 6,015,157 | A | * | 1/2000 | Hilgarth | 280/11.27 |
| 6,053,512 | A | * | 4/2000 | Chang | 280/11.225 X |

FOREIGN PATENT DOCUMENTS

| | | |
|---|---|---|
| CA | 2201814 | * 10/1998 |
| DE | 297 19 939 | 2/1998 |
| EP | 0 799 629 | 10/1997 |
| WO | WO 98/24525 | 6/1998 |
| WO | 98/33565 | * 8/1998 |

* cited by examiner

*Primary Examiner*—Lesley D. Morris
*Assistant Examiner*—Paul Royal, Jr.
(74) *Attorney, Agent, or Firm*—RatnerPrestia

(57) ABSTRACT

An in-line roller skate. The skate is made of a boot having a front portion, a rear portion, and a truck chassis for supporting a plurality of rotatably mounted in-line wheels. The wheels define the rolling plane of the in-line roller skate. The truck chassis is pivotally connected to the rear portion of the boot by a pivot-like member and is connected to the front of the boot by a translating connection member. The translating connection member allows a sliding movement of the boot with relation to the chassis along a given length in a direction substantially normal with relation to the rolling plane. The in-line skate further comprises a resilient member located between the front portion of the chassis and the front portion of the boot for absorbing vibrations in the in-line roller skate.

20 Claims, 7 Drawing Sheets

ERGONOMIC SKATE BOOT WITH SHOCK ABSORBER

This is the U.S. National Phase of International Application No. PCT/CA98/00443, filed on May 1, 1998.

FIELD OF INVENTION

This invention relates to in-line roller skates and more particularly to a shock absorbing mechanism in an in-line roller skate.

BACKGROUND OF THE INVENTION

Roller skates, since their inception have been plagued with vibration problems particularly when they are used on rough surfaces, in particular outdoor surfaces, such as asphalt roads or concrete sidewalks. Attempts have been made to dampen such vibrations by placing cushions between the truck chassis and the boot. For instance, cushions covering the entire foot length have been placed between the boot and the chassis. In other embodiments, cushions have been placed between the chassis and the ball of the foot and the heel of the foot.

An unfortunate thing about resisting vibrations is that one loses some control. In other words, the more antivibrational type padding is used, the less control the boot has. One of the drawbacks when using back and front cushions is that the cushions, while damping vibrations, also damp the force and energy transmitted from the foot to the frame. The skater has less control than with a skate without cushions.

Thus, there is a need in the industry to provide a roller skate with improved anti-vibrations characteristics, but without reducing the control and general performance of the skates.

SUMMARY OF THE INVENTION

It is thus an object of the invention to provide a roller skate providing simultaneously improved control to the skater and comfort through the reduction of vibration.

As embodied and broadly described herein, the invention provides an in-line roller skate comprising:

- a boot for enclosing a skater's foot and having a front portion substantially corresponding to a toes region of a wearers foot, and a rear portion substantially corresponding to the heel region of a wearer's foot;
- a lower truck chassis adapted to be supported by a plurality of rotatably mounted in-line wheels defining a rolling plane;
- said chassis being pivotally connected to said rear portion of the boot by a pivot-like member and to said front portion of the boot by a translating connection member, said translating connection member being adapted to provide a translation movement of the boot with relation to the chassis along a given length in a direction substantially normal with relation to said rolling plane;
- said skate further including a resilient member located between a front portion of the chassis and said front portion of the boot.

Vibrations are thus damped in the most critical areas. The connection between the boot and the chassis ensures efficient control of the skates.

In a variant the pivot-like member is comprised of a pivot pin.

In another variant, the pivot-like member is comprised of hinge-like member.

In another variant, the hinge-like member is of resilient type.

These all provide ease of manufacturing and low cost.

The resilient member is advantageously comprised of a resilient pad.

The translating connection member is advantageously comprised of an elongated slot, provided in either one of said chassis or said boot, adapted to receive a sliding member, adapted to connect said boot to said chassis. The boot and the chassis are thus well connected, providing enhanced control of the skates. The slot provides one degree of freedom, allowing vibration damping with the use of the resilient member.

The roller skate of the invention also preferably comprises a stabilizing member, extending from either one of said boot or said chassis to cooperate with a corresponding member, provided on the other of said boot and said chassis, said members being adapted to provide lateral support of the boot with relation to the chassis. This provides improved stability and enhanced control of the skates.

As embodied and broadly described herein, the invention also provides an in-line roller skate comprising a boot with at least one pair of downwardly extending substantially parallel extensions, more particularly one forward pair, a lower truck chassis adapted to be supported by a plurality of rotatably mounted in-line wheels defining a rolling plane, said chassis including a pair of front substantially elongated slots extending along an axis substantially normal with relation to said rolling plane, said chassis being connected to a rear portion of the boot by a pivot-like member and to said front extensions by a slidable connecting member adapted to move within said slots, said skate further including a resilient member located between a front upper part of the chassis and a front portion of an outer sole of the boot.

In operation, said boot is adapted to pivot about said pivot member relative to said chassis and move upwardly or downwardly relative to the front of said chassis, thereby reducing vibration by up and down movement which causes decompression and compression of said resilient pad respectively.

Advantageously the boot further comprises a rear pair of downwardly extending substantially parallel extensions. The pair of rear extensions preferably includes a pair of coaxial apertures.

The chassis is advantageously connected to said rear extensions.

In a variant, the chassis includes a pair of co-axial rear apertures; the chassis is preferably connected to said rear extensions with pivot members provided in said apertures.

The present invention uses a piece of flexible cushion under the front sole of the foot. There is a fixed point of attachment between the heel region of the boot and the truck chassis. This fixed point of attachment is, however, pivotal. A second point of attachment between the front portion of the boot and the chassis has substantially vertical play. The aperture in the chassis (or in the boot if the construction is reversed) is a substantially vertically elongate slot permitting a connecting member to move substantially upwardly and downwardly. The front interface has a vertical play of a few millimeters. Movement is permitted in one direction, i.e., the direction of the flex. Thus, the system permits good control in other directions where stability is important.

The shock absorber of the present invention works virtually only in the places where most shocks are felt. This system is particularly adapted to the maneuvers of a skater who flexes forwardly as he skates. It is more important to keep good control behind with a fixed pivot point and a moveable point in front.

Thus, in summary, the present invention has a pivot attaching the boot to the truck chassis side rails at the rear and a point of attachment of substantially vertical play at the front. The flexible resilient cushion under the ball of the foot is advantageously between the boot and the truck chassis.

Other objects and features of the invention will become apparent by reference to the following description and the drawings.

BRIEF DESCRIPTION OF THE DRAWINGS

A detailed description of the preferred embodiments of the present invention is provided herein below, by way of example only, with reference to the accompanying drawings, in which.

Figure 1:
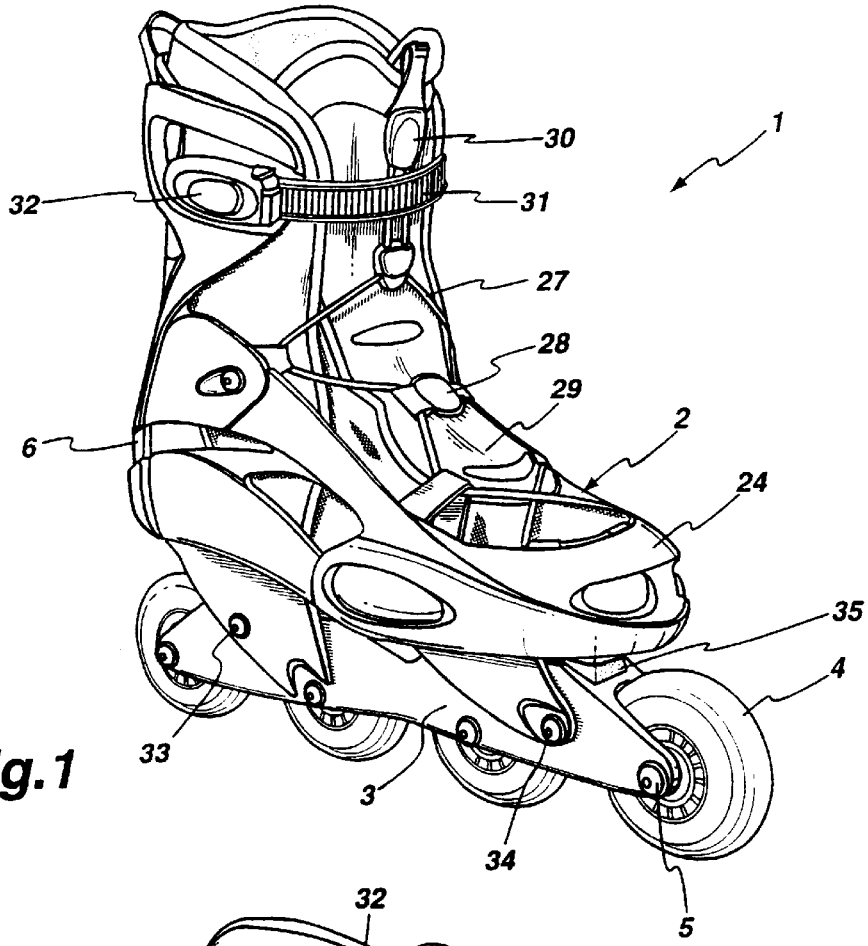
FIG. 1 is a perspective view of the roller skate of the present invention.

In the drawings, preferred embodiments of the invention are illustrated by way of examples. It is to be expressly understood that the description and drawings are only for a purpose of illustration and are an aid for understanding. They are not intended to be a definition of the limits of the invention.

DETAILED DESCRIPTION OF THE INVENTION

Figure 2:
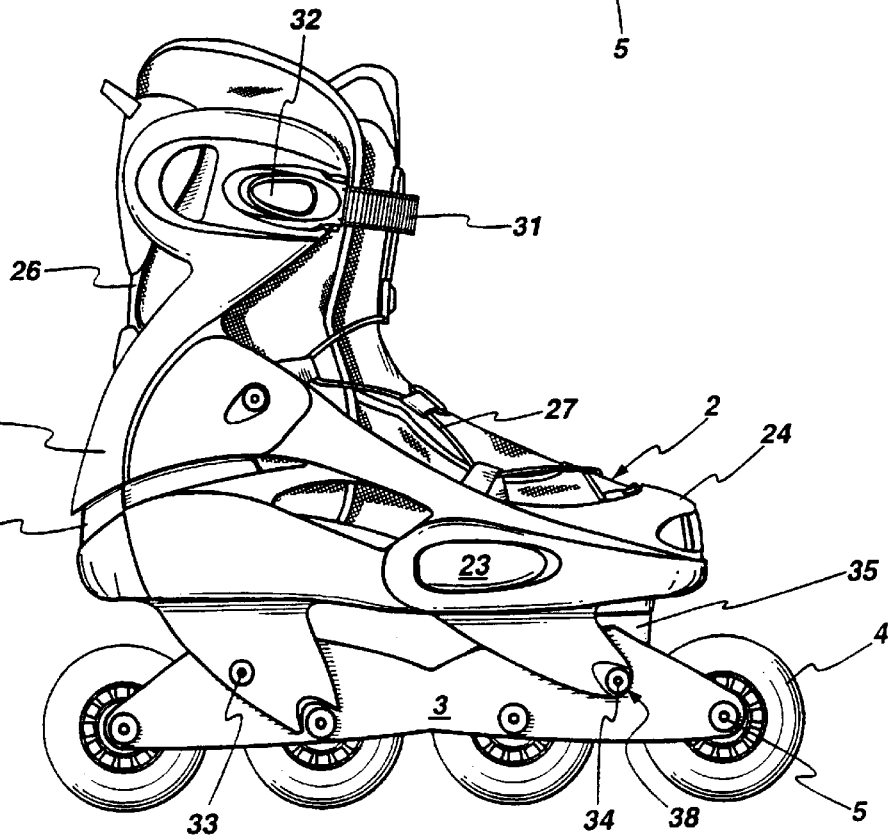
FIG. 2 is a side view of the present invention.

The present invention, as shown in FIGS. 1 and 2, comprises an in-line roller skate shown basically as 1. The in-line roller skate 1 consists of a boot 2, which is attached to a wheel chassis 3. Rotatably mounted within the side walls of the wheel chassis 3 are a plurality of aligned wheels 4. Wheels 4 are mounted on axles 5 in a conventional manner.

Figure 3:
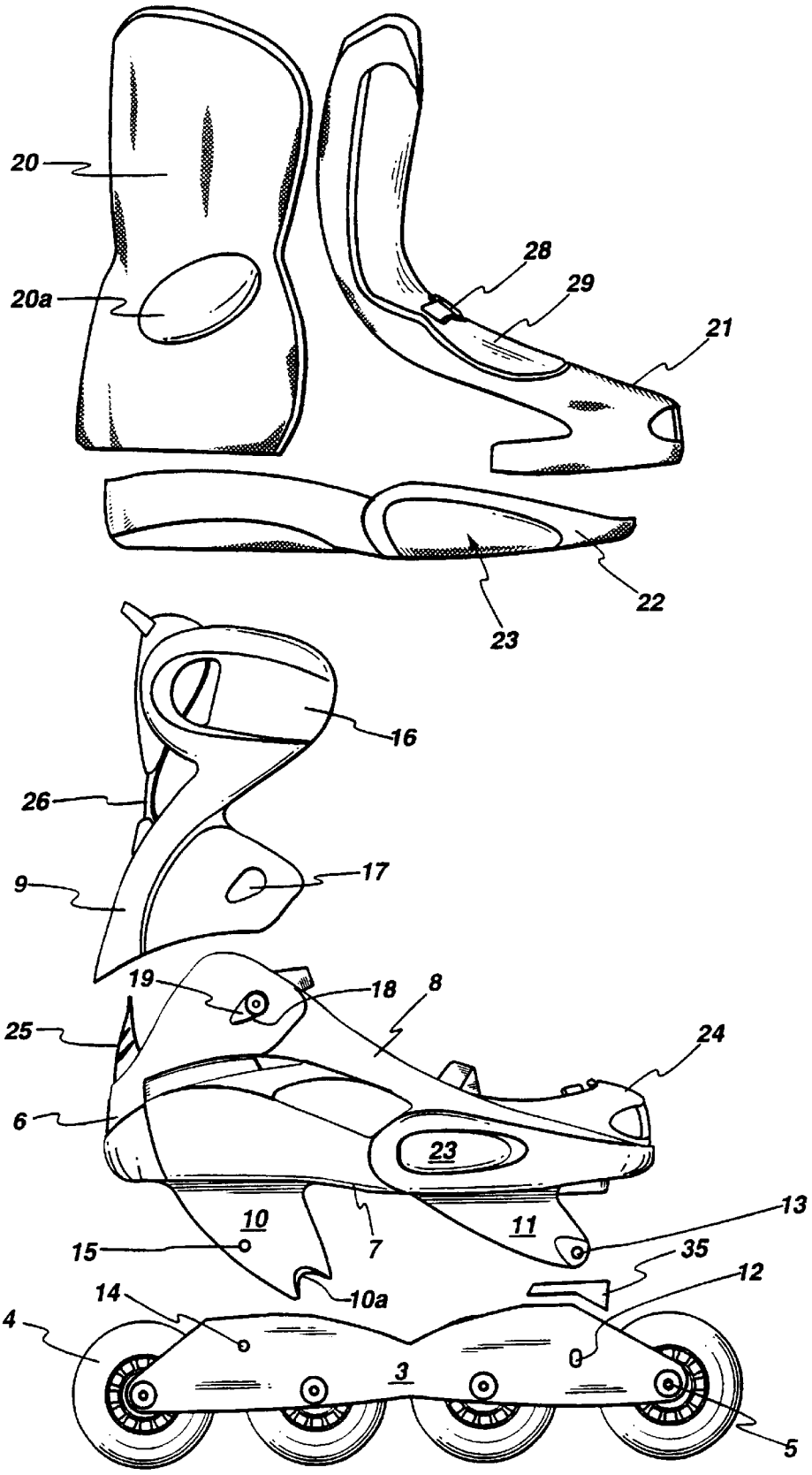
FIG. 3 is a side view of the major components of the inner boot, outer boot and truck chassis.

According to one embodiment of the invention, the boot portion of the skate consists of a partial outer boot and an inner liner. The outer boot may comprise an elastic wrap-around heel support 6, as shown in FIGS. 1, 2 and 3. The type of boot illustrated in FIGS. 1 to 9 is arranged for more comfort, ergonomics and performance. Other types of boots may also be used in accordance with the present invention.

An upper cuff 9, which is pivotally connected to the lower outer boot, provides ankle support. FIG. 3, shows a pair of rear lower boot extensions 10 and a pair of front lower boot extensions 11 advantageously integrally molded with the lower outer boot. These extensions are configured to attach the boot to the truck chassis 3. Preferably, the rear lower boot extensions have indentations 10*a* adapted to encircle one of the wheel axles 5 to avoid interference with the axle. The forepart of the truck chassis 3 has a pair of substantially vertically elongate apertures 12 which are adapted to align with apertures 13 in the front lower boot extension 11.

FIGS. 1 and 2, illustrate the translating connection member 38: for instance, a substantially vertically slidable front connecting pin 34 connects apertures 12 and 13. In the rear of chassis 3, is a pair of apertures 14 adapted to cooperate and align with pivot point apertures 15 located in rear lower boot extensions 10. The position of the apertures 14 and/or 15 may vary depending on the construction and the desired characteristics. Rear pivot pin 33 connects apertures 14 and 15 to pivotally secure the rear lower boot extensions 10 of boot 2 to the chassis while vertically slidable front connecting pin 34 connects front lower boot extensions 11 of the boot 2 to the front portion of the chassis 3 at vertically elongate apertures 12. The position of aperture 13 and the position and/or orientation of the aperture 12 may also vary according to the desired construction and characteristics.

As shown more clearly in FIG. 3, upper cuff outer boot 9 advantageously contains a buckle aperture 16 and an upper flex pivot aperture 17. This is adapted to cooperate with lower flex pivot aperture 18 found in the lower outer boot. A flex device 19 is adapted to fit within upper flex pivot aperture 17 and lower flex pivot aperture 18.

As shown more clearly in the upper portion of FIG. 3, the liner or inner boot consists of a rear inner boot 20 equipped with an ankle cushioning pad 20*a*. The liner also consists of a front inner boot 21. Rear and front inner boots 20 and 21 rest on an inner boot base 22.

The skater's foot is secured in the boot by means of laces 27 which traverse lace holders 28, these being located on a lace support pad 29 which is integrally connected to the front inner boot 21. An upper lace tightener 30 is used to tighten the laces.

Support to the ankle region and the upper cuff is provided by a strap 31 which is adapted to be secured within buckle 32 to tighten the upper cuff outer boot 9.

As shown in FIGS. 1, 2 and 3, a resilient member, for instance one (or more) elastomeric absorber or pad 35 is placed between the sole of boot 2 and the skate chassis 3 at the front portion thereof to provide resiliency in a substantially vertical direction as the boot 2 pivots in relation to the skate chassis 3 about pivot member 33. The pad could also be made removable. In such a case, a set of pads of different characteristics and/or different materials could be provided. The skater selects the pads according to his skills or type of skating, with more or less damping.

Figure 4:
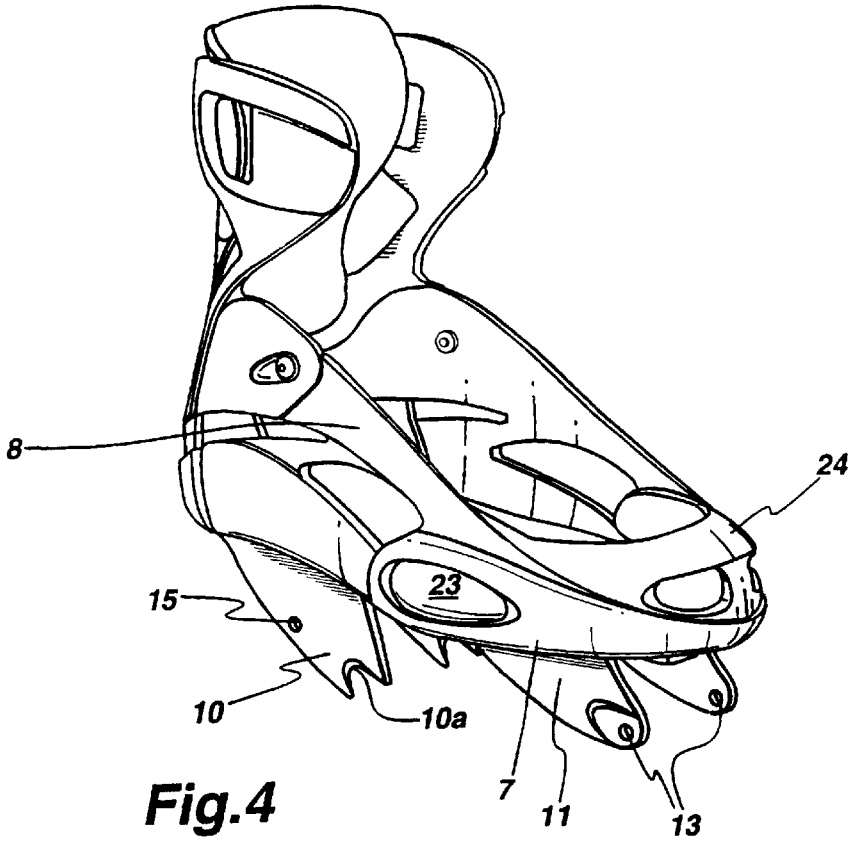
FIG. 4 is a front perspective view of the outer boot.
Figure 5:
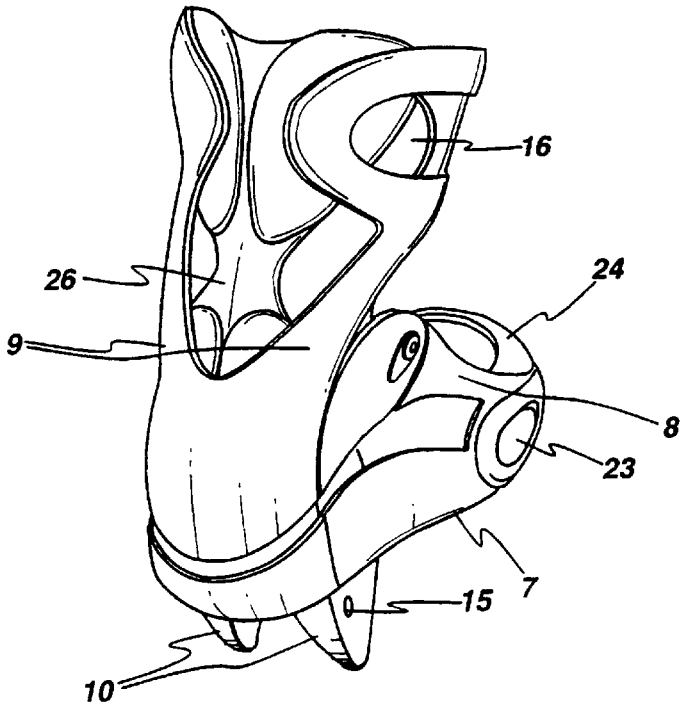
FIG. 5 is a rear perspective view of the outer boot.

FIGS. 4 and 5 show other details of this boot embodiment. The outer boot with its various padding elements without liner portions 20, 21 and 22. The tendon cushioning portion 26 and the fifth metatarsal padding 23, are shown. In FIGS. 4 and 5 one sees that the upper cuff outer boot 9 is connected to the heel support lower outer boot 6 by means of flex device 19.

In FIGS. 6, 6*a*, 7 and 7*a*, one views the shock absorber in an uncompressed situation and in a compressed situation. The distance between the bottom of the boot and the top of the chassis in an uncompressed situation is "X", whereas, in a compressed situation, the distance between the boot and chassis "$X^1$" is smaller.

An arc, through which translating connection member 38, for instance pin 34 (in an uncompressed situation and in a compressed situation) moves, is labeled as 36.

Figure 6:
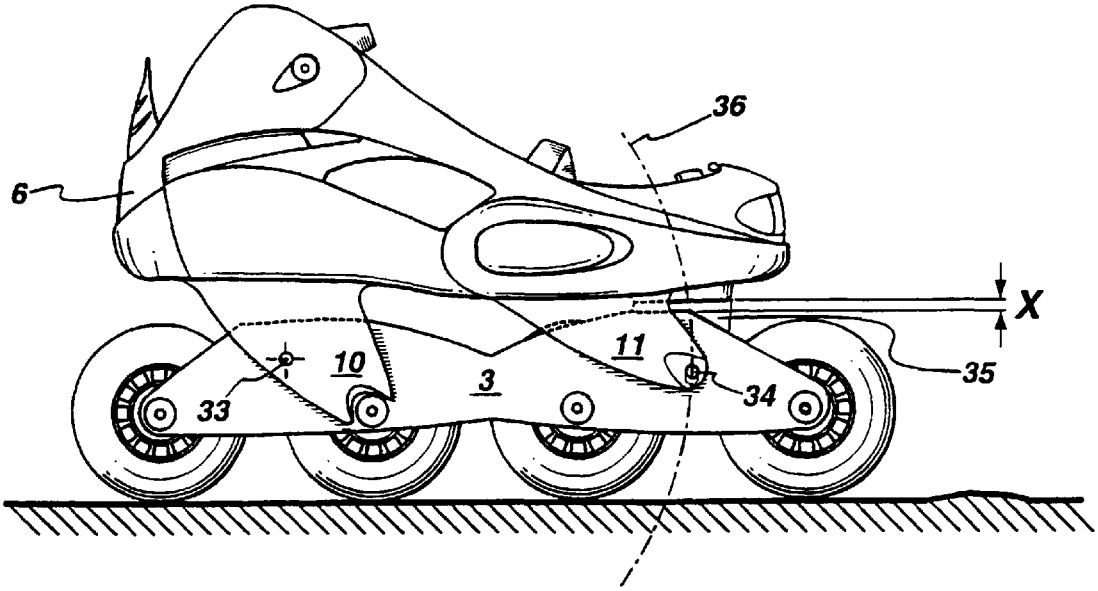
FIGS. 6 and 6*a* side views of the lower portion of the outer boot attached to the truck chassis with a shock absorber in an uncompressed position.
Figure 6A:
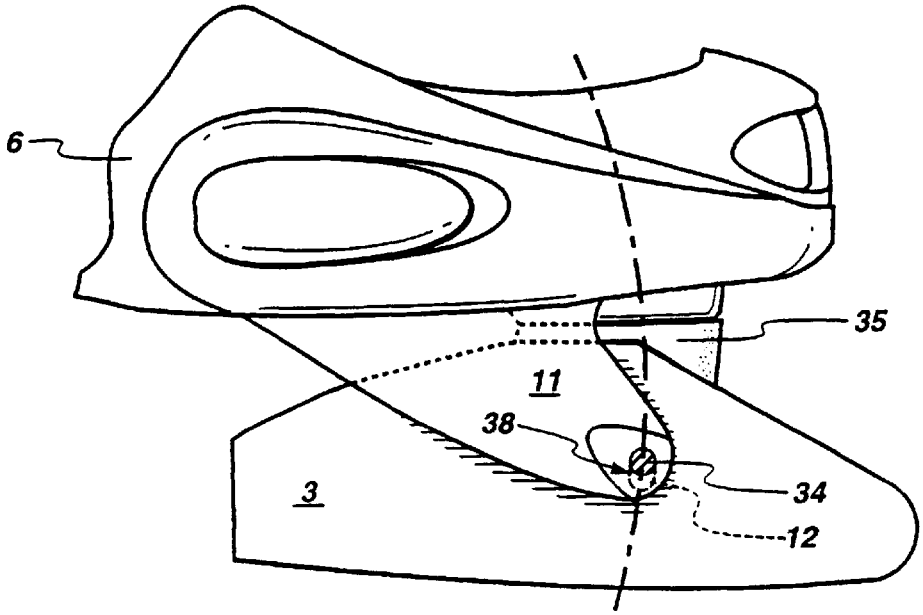
Figure 7:
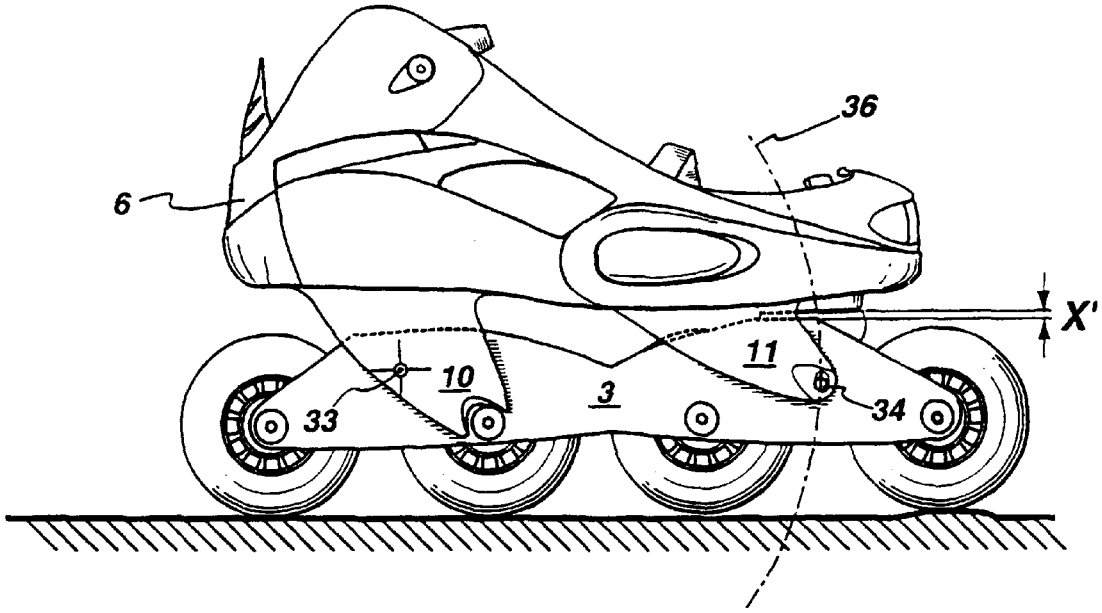
FIGS. 7 and 7*a* are similar side views of that of FIG. 6 with a shock absorber in a compressed state.
Figure 7A:
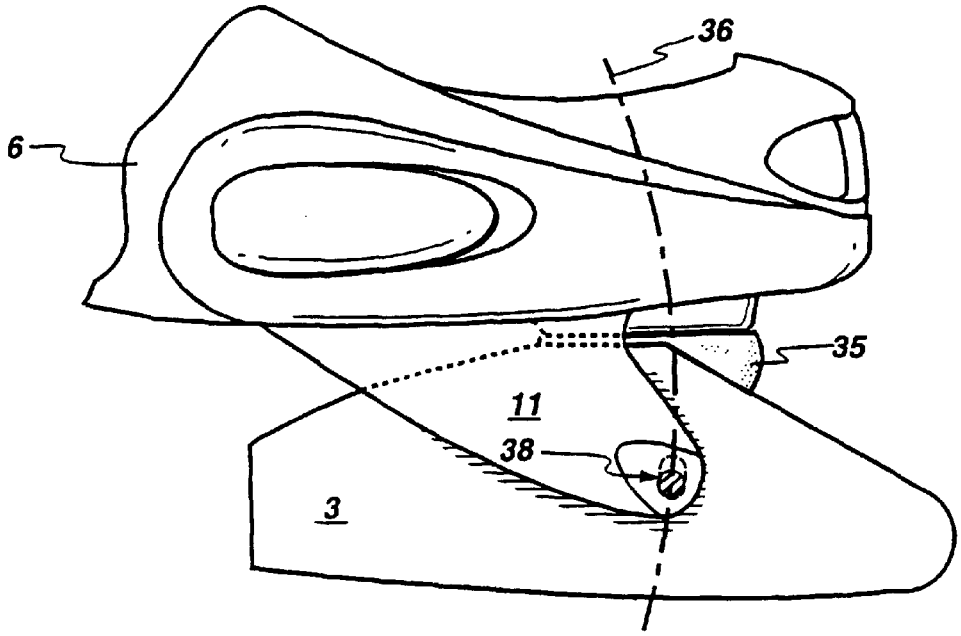

From FIGS. 6 and 7, one notes that the rear of the boot is stationary with regard to the chassis in a sense of equal distance, because it pivots about a pivot member, for instance a pin 33. Whereas, the front of the boot can move upwardly or downwardly as pin 34 moves up and down in an elongate slot 12 as shown in FIG. 3. Thus, vibration is reduced where it most occurs. The remainder of the boot has full control and support with regard to the truck chassis 3.

Figure 10:
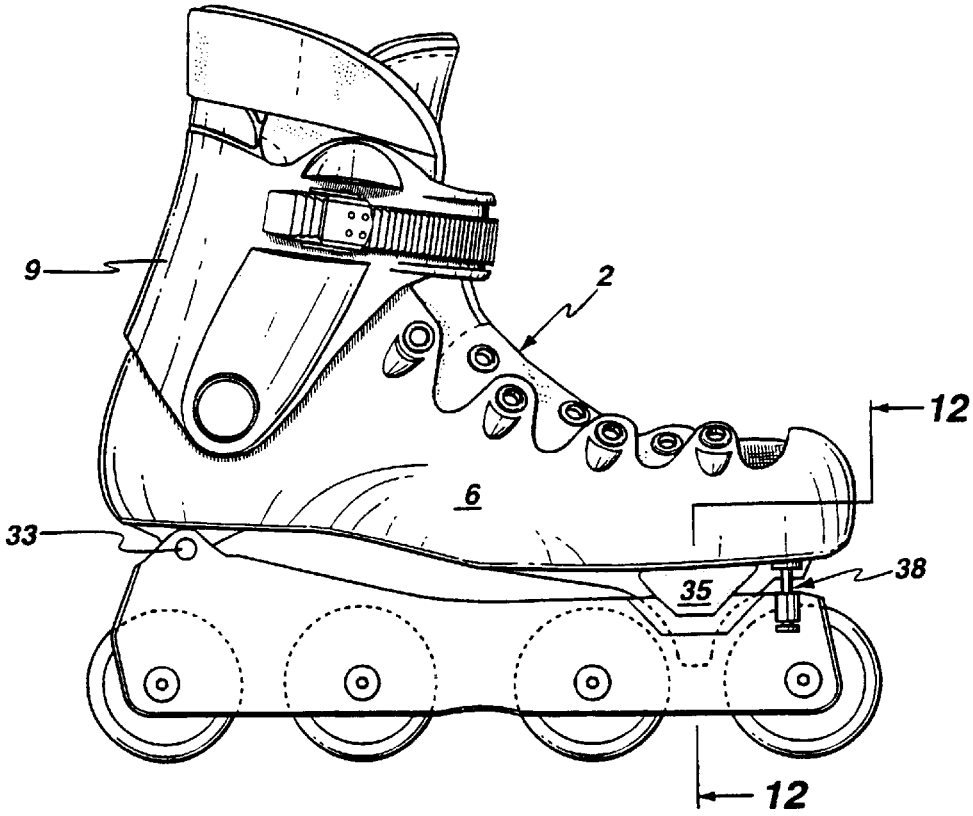

The above description of preferred embodiments should not be interpreted in a limiting manner since variations, modifications or refinements are possible within the spirit and scope of the present invention. For instance, the boot described herein above and illustrated is designed to improve comfort and performance. Any type of boot could also be used with the present invention, for instance of rigid, semi-rigid or soft type, with or without inner finer, etc. FIG. 10 illustrates an example of a different type of boot with a rigid outer shell and a soft inner liner.

Figure 8:
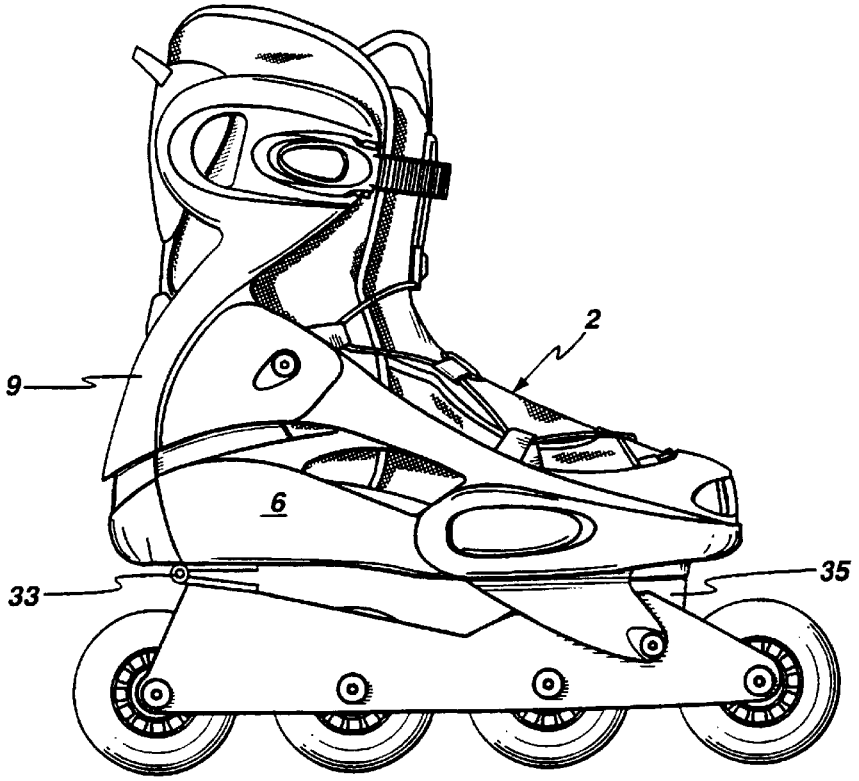
FIGS. 8, 9 and 10 are side views of the roller skate of the invention provided with different types of pivoting members between the boot and the chassis.
Figure 9:
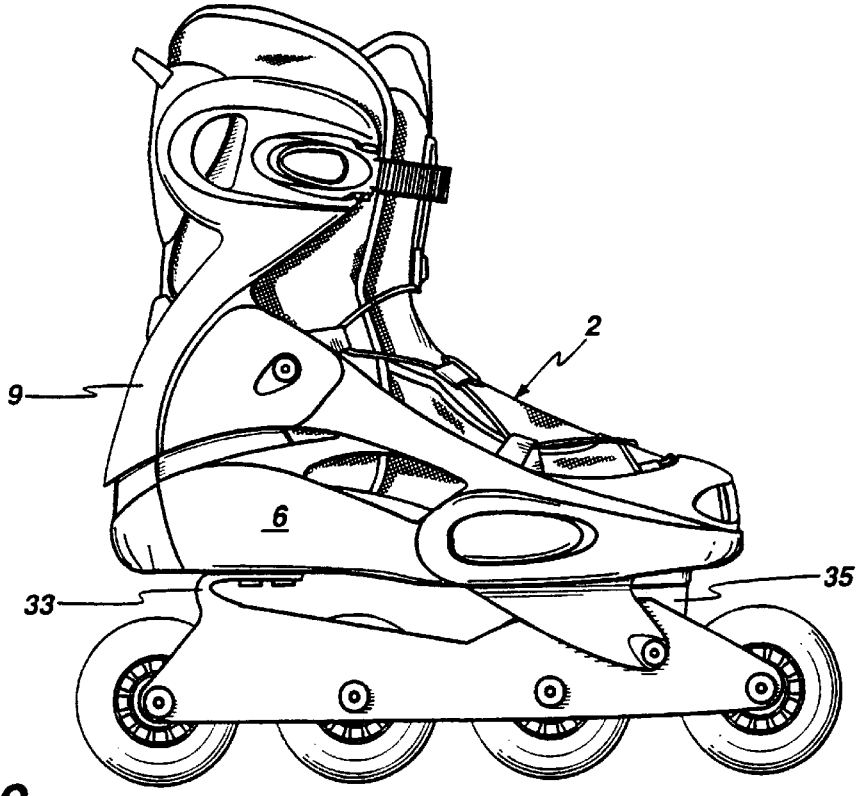

The rear pivot-like member could also be different, for instance of hinge-like type. FIG. 8 illustrates a variant using a standard hinge 33. FIG. 9 illustrates a variant with a flexible hinge.

The pivot-like member may be provided at different locations, for instance between the bottom of the heel and the top of the chassis, as shown in FIGS. 2, 8, 9 and 10.

Figure 11:
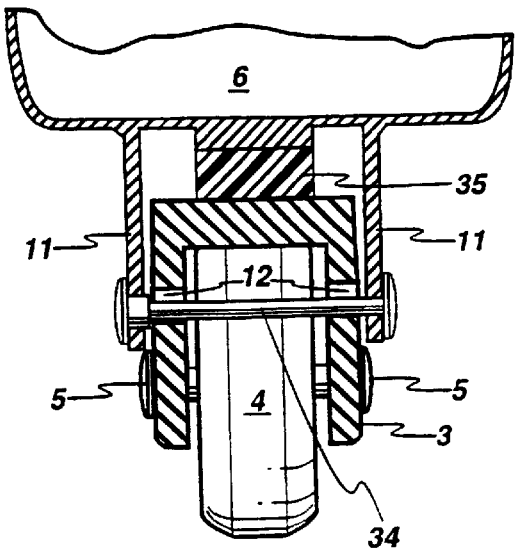
FIGS. 11 and 12 are elevation views showing different arrangements of the resilient member.
Figure 12:
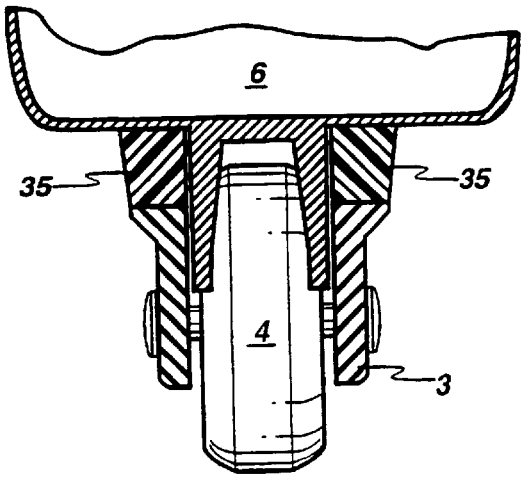

The resilient member may be arranged in several ways, as shown for instance in FIGS. 11 and 12. In FIG. 11, the resilient member is comprised of one centrally placed resilient pad. In FIG. 12, the resilient member is comprised of two laterally placed resilient pads. In the latter case, the attachment between the front boot portion and the front chassis portion may be achieved in using a different type of translating connection member, for instance a connecting rod arrangement (or other similar arrangement) adapted to provide limited translation movement, as shown in FIG. 10.

The scope of the invention is defined in the appended claims and their equivalents.

What is claimed is:

1. An in-line roller skate having a plurality of rotatably mounted in-line wheels, the skate comprising:

(a) a frame having two parallel rails for supporting the wheels, said rails comprising respective rear and front portions;

(b) a boot for enclosing a foot of a wearer, the foot having a toes region, a heel region and a plantar surface having a contour, said boot comprising a front portion substantially corresponding to the toes region, a rear portion substantially corresponding to the heel region and a sole portion following the contour of the plantar surface;

(c) a pair of rear extensions and a pair of front extensions, said extensions projecting downwardly from said sole portion;

(d) a pivot member interconnecting said rear portion of said rails and said rear extensions;

(e) a front member interconnecting said front portion of said rails and said front extensions, said front member allowing said front portion of said rails to move toward said sole portion; and (f) a resilient member located between said sole portion and said front portion of said rails, wherein, in operation, said front portion of said rails can move toward said sole portion by compressing said resilient member and causing said rear extensions and said rear portion of said rails to pivot relative to one another about said pivot member, said front member moving along an arc of a circle having a center at said pivot member.

2. The skate as defined in claim 1 wherein said front portion of said rails comprises a front bridge connecting said rails.

3. The skate as defined in claim 2 wherein said resilient member is mounted on said front bridge.

4. The skate as defined in claim 3 wherein each pair of rear and front extensions comprises co-axial apertures.

5. The skate as defined in claim 4 wherein said pivot member extends from one of said co-axial apertures of said rear extensions to the other of said co-axial apertures.

6. The skate as defined in claim 5 wherein said front member extends from one of said co-axial apertures of said front extensions to the other of said co-axial apertures.

7. The skate as defined in claim 6 wherein said pivot member and said front member are respective pivot pin and front pin.

8. The skate as defined in claim 7 wherein said resilient member is a resilient pad.

9. The skate as defined in claim 1 wherein said sole portion comprises an abutting portion projecting downwardly therefrom, said abutting portion contacting said resilient member when said front portion of said rails moves toward said sole portion.

10. The skate as defined in claim 1 wherein said plurality of wheels comprises a front wheel and wherein movement of said front portion of said rails toward said sole portion begins when said front wheel abuts an obstacle.

11. An in-line roller skate having a plurality of rotatably mounted in-line wheels, the skate comprising:

(a) a frame having two parallel rails for supporting a plurality of rotatably mounted in-line wheels, said rails comprising respective rear and front portions with the front portion comprising a front bridge connecting said rail;

(b) a boot for enclosing a foot of a wearer, the foot having a toes region, a heel region and a plantar surface having a contour, said boot comprising a front portion substantially corresponding to the toes region, a rear portion substantially corresponding to the heel region and a sole portion following the contour of the plantar surface;

(c) a pair of rear extensions and a pair of front extensions, said extensions projecting downwardly from said sole portion;

(d) a pivot pin interconnecting said rear portion of said rails and said rear extensions;

(e) a front pin interconnecting said front portion of said rails and said front extensions, said front pin allowing said front portion of said rails to move toward said sole portion; and (f) a resilient pad mounted on said front bridge and located between said sole portion and said front portion of said rails, wherein, in operation, said front portion of said rails can move toward said sole portion by compressing said resilient member and causing said rear extensions and said rear portion of said rails to pivot relative to one another about said pivot pin, said front pin moving along an arc of a circle having a center at said pivot pin.

12. The skate as defined in claim 11 wherein each pair of rear and front extensions comprises co-axial apertures.

13. The skate as defined in claim 12 wherein said pivot pin extends from one of said co-axial apertures of said rear extensions to the other of said co-axial apertures.

14. The skate as defined in claim 13 wherein said front pin extends from one of said co-axial apertures of said front extensions to the other of said co-axial apertures.

15. The skate as defined in claim 11 wherein said sole portion comprises an abutting portion projecting downwardly therefrom, said abutting portion contacting said resilient pad when said front portion of said rails moves toward said sole portion.

16. The skate as defined in claim 11 wherein said plurality of wheels comprises a front wheel and wherein movement of said front portion of said rails toward said sole portion begins when said front wheel abuts an obstacle.

17. An in-line roller skate having a plurality of rotatably mounted in-line wheels, the skate comprising:

(a) a frame having two parallel rails for supporting a plurality of rotatably mounted in-line wheels, said rails comprising respective rear and front portions;

(b) a boot for enclosing a foot of a wearer, the foot having a toes region, a heel region and a plantar surface having a contour, said boot comprising a front portion substantially corresponding to the toes region, a rear portion substantially corresponding to the heel region and a sole portion following the contour of the plantar surface;

(c) a pair of rear extensions and a pair of front extensions, said extensions projecting downwardly from said sole portion;

(d) a pivot pin interconnecting said rear portion of said rails and said rear extensions;

(e) a front pin interconnecting said front portion of said rails and said front extensions, said front pin allowing said front portion of said rails to move toward said sole portion; and (f) a resilient member located between said sole portion and said front portion of said rails, wherein, in operation, said front portion of said rails can move toward said sole portion by compressing said resilient member and causing said rear extensions and said rear portion of said rails to pivot relative to one another about said pivot pin, said front pin moving along an arc of a circle having a center at said pivot pin, wherein said sole portion comprises an abutting portion projecting downwardly therefrom, said abutting portion contacting said resilient pad when said front portion of said rails moves toward said sole portion, and said plurality of wheels comprises a front wheel and movement of said portion of said rails toward said sole portion begins when said front wheel abuts an obstacle.

18. The skate as defined in claim 17 wherein each pair of rear and front extensions comprises co-axial apertures.

19. The skate as defined in claim 18 wherein said pivot pin extends from one of said co-axial apertures of said rear extensions to the other of said co-axial apertures.

20. The skate as defined in claim 19 wherein said front pin extends from one of said co-axial apertures of said front extensions to the other of said co-axial apertures.

* * * * *